US008662921B2

(12) United States Patent
Kataoka

(10) Patent No.: US 8,662,921 B2
(45) Date of Patent: Mar. 4, 2014

(54) DUMMY PLUG

(75) Inventor: Shigeto Kataoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 64 days.

(21) Appl. No.: 13/412,905

(22) Filed: Mar. 6, 2012

(65) Prior Publication Data

US 2012/0238135 A1 Sep. 20, 2012

(30) Foreign Application Priority Data

Mar. 18, 2011 (JP) ..... 2011-060897

(51) Int. Cl.
*H01R 13/40* (2006.01)

(52) U.S. Cl.
USPC ..... 439/587; 439/148

(58) Field of Classification Search
USPC ..... 439/148, 149, 271, 274, 275, 587, 589
See application file for complete search history.

(56) References Cited

U.S. PATENT DOCUMENTS

| | | | | |
|---|---|---|---|---|
| 5,551,892 | A * | 9/1996 | Endo et al. | 439/587 |
| 5,707,251 | A * | 1/1998 | Sakai et al. | 439/589 |
| 6,390,848 | B1 * | 5/2002 | Murakami et al. | 439/587 |
| 6,808,418 | B2 * | 10/2004 | Horner | 439/587 |
| 7,270,556 | B2 * | 9/2007 | Mori et al. | 439/272 |
| 7,559,797 | B2 * | 7/2009 | Shishikura et al. | 439/587 |

FOREIGN PATENT DOCUMENTS

JP 2008-305660 12/2008

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A dummy plug (50) includes a sealing portion (51) to be fit into a seal hole (21) in a liquid-tight manner when the dummy plug (50) is mounted into a connector (A). A support (53) is arranged behind the sealing portion (51). Two resilient locking pieces (56) link the rear end of the sealing portion (51) and the front end of the support (53) and engage with retaining portions (34) of a holder (30) when the dummy plug (50) is mounted into the connector (A). A single deformation space (57) is provided between the resilient locking pieces (56) and is shared to permit resilient deformations of the resilient locking pieces (56).

8 Claims, 6 Drawing Sheets

DUMMY PLUG

BACKGROUND OF THE INVENTION

1. Field of the Invention

The invention relates to a dummy plug.

2. Description of the Related Art

Japanese Unexamined Patent Publication No. 2008-305660 discloses a connector that includes a housing formed with a plurality of terminal accommodating chambers. A one-piece rubber plug is mounted in a rear end portion of the housing and includes a plurality of seal holes corresponding to the terminal accommodating chamber. A holder is arranged behind the one-piece rubber plug and includes a plurality of through holes corresponding to the seal holes. Terminal fittings are inserted through the through holes and the seal holes and into the terminal accommodating chambers.

A dummy plug is mounted in the connector. The dummy plug is long and narrow in forward and backward directions and formed. A waterproof portion is formed at a front end portion of the dummy plug and a plate-like operating portion extends back from the rear end of the waterproof portion. The operating portion can be grasped to pull the dummy plug out. Two resilient locking pieces extend backward from a front part of the operating portion and are supported on one end.

The waterproof portion penetrates through the seal hole of the one-piece rubber plug to close the seal hole in a liquid-tight manner when the dummy plug is mounted into the connector. Further, the operating portion penetrates through the through hole of the holder and the resilient locking pieces engage an edge region of the through hole on the front surface of the holder. This engagement of the resilient locking pieces and the holder holds dummy plug in a retained state.

The resilient locking pieces of the dummy plug are supported on one end. As a result, there is a problem that deformation rigidity is relatively low and engaging forces of retaining portions and the resilient locking pieces are weak. Further, the two resilient locking pieces are arranged at opposite sides of the operating portion. As a result, the resilient locking pieces are deformed resiliently in directions toward the outer surfaces of the operating portion when the operating portion and the resilient locking pieces pass through the through hole. The opening dimension of the through hole is set. Thus, a deformation margin of the resilient locking pieces is limited to a dimension obtained by subtracting the thickness of the operating portion and thicknesses of the resilient locking pieces from the opening dimension of the through hole and it is difficult to ensure a sufficiently large deformation margin. The deformation margin of the resilient locking pieces is an engagement margin of the resilient locking pieces and the holder. Accordingly, the reliability of a retaining function of the dummy plug is problematically low.

The invention was completed based on the above situation and an object thereof is to improve the reliability of a retaining function.

SUMMARY OF THE INVENTION

The invention is directed to a dummy plug to be mounted in a connector. The connector includes a housing formed with a plurality of terminal accommodating chambers. A one-piece rubber plug is mounted in a rear end portion of the housing and includes a plurality of seal holes corresponding to the terminal accommodating chambers. A holder is arranged behind the one-piece rubber plug and includes a plurality of through holes corresponding to the seal holes. The dummy plug includes a sealing portion to be fit into the seal hole in a liquid-tight manner when the dummy plug is mounted into the connector. The dummy plug also has a support arranged behind the sealing portion. Two resilient locking pieces link the rear end of the sealing portion and the front end of the support and engage retaining portions of the holder for retaining the dummy plug in the connector. A single deformation space is provided between the two resilient locking pieces to permit resilient deformations of the resilient locking pieces.

The resilient locking pieces engage the retaining portions to hold the dummy plug in the retained state in the connector. The resilient locking pieces are supported on both front and rear ends by the sealing portion and the support. Thus, deformation rigidity is high and engaging forces of the resilient locking pieces and the retaining portions are strong as compared with resilient locking pieces supported on one end. In addition, the two resilient locking pieces share the deformation space. Thus, only the deformation space is present between the resilient locking pieces. Accordingly, a sufficiently large warping margin is ensured for the resilient locking pieces. The reliability of a retaining function is improved because the engaging forces of the resilient locking pieces and the retaining portions are increased and a sufficient engagement margin is ensured for the resilient locking pieces and the retaining portions as just described.

The dummy plug may further comprise an operating portion projecting back from the holder when the dummy plug is mounted into the connector. The operating portion is used to mount and remove the dummy plug into and from the connector. At least part of the operating portion functions as the support.

The part of the operating portion used to mount and remove the dummy plug into and from the connector functions as the support for supporting the resilient locking pieces on both ends. Thus, the shape of the dummy plug can be simplified.

The dummy plug may further comprises an erroneous insertion preventing portion engageable with a fitting of the holder only when the dummy plug is in a correct posture in a circumferential direction about the axis line of the sealing portion.

A dummy plug that is fit into the through hole in an improper posture and/or with the axis lines of the seal hole and the through hole deviated from each other can adversely affect the sealing performance. However, the erroneous insertion preventing portion of the present invention is engageable with the fitting portion of the holder only when the dummy plug is in the correct posture in the circumferential direction about the axis line of the sealing portion. Hence, the dummy plug cannot be mounted in an improper posture and there will be no reduction in the sealing performance.

DETAILED DESCRIPTION OF THE PREFERRED EMBODIMENTS

Figure 1:
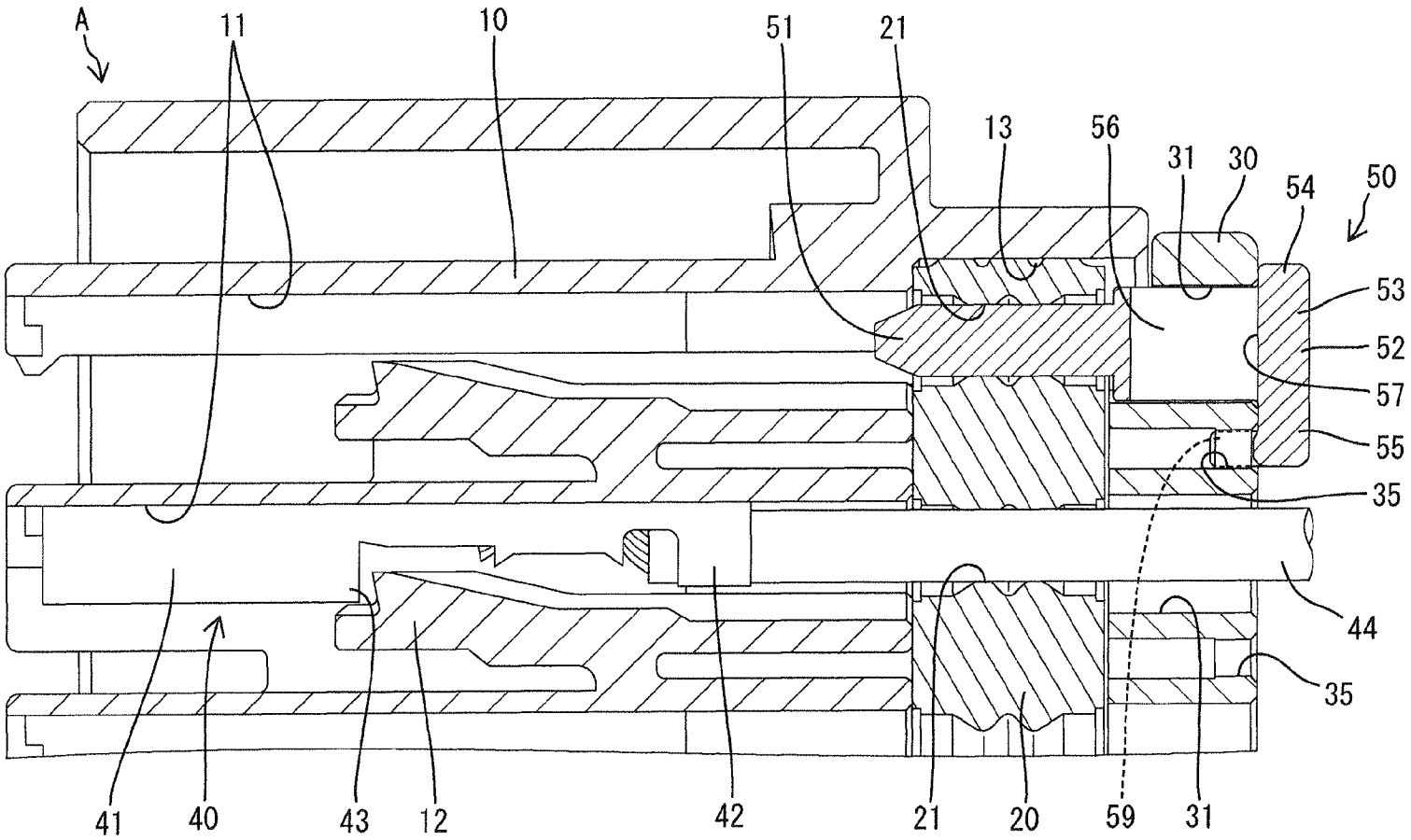
FIG. 1 is a vertical section of a connector according to an embodiment.
Figure 2:
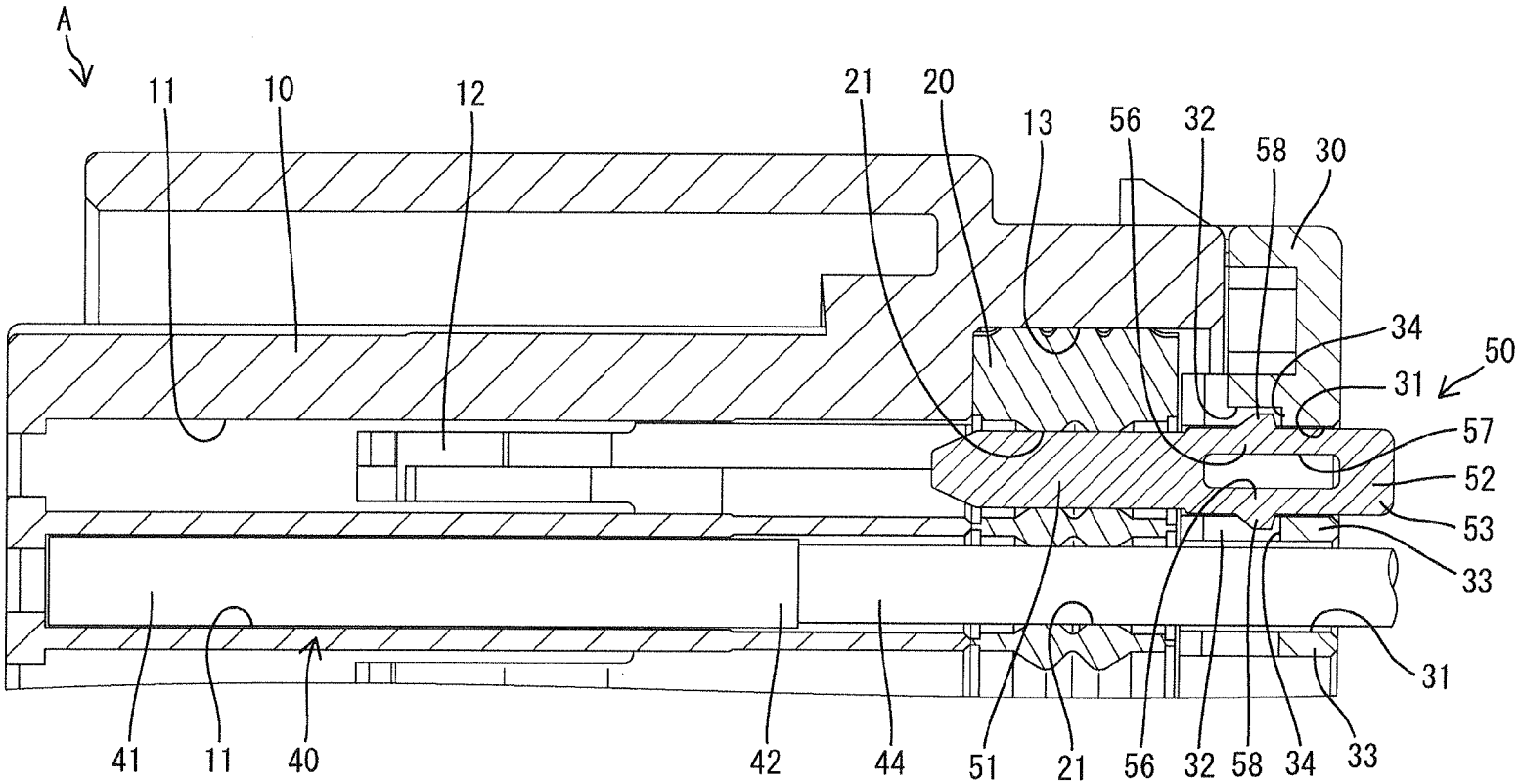
FIG. 2 is a horizontal section of the connector.

A connector A in accordance with the invention includes a housing 10, a one-piece rubber plug 20, a holder 30, terminal fittings 40 and a dummy plug 50, as shown in FIGS. 1 and 2.

The housing 10 is made of synthetic resin and terminal accommodating chambers 11 penetrate the housing 10 in forward and backward directions while being arrayed in vertical and lateral directions. A locking lance 12 is formed unitarily with a lower wall portion of each terminal accommodating chamber 11 and is cantilevered forward (left in FIGS. 1 and 2). Each locking lance 12 is resiliently deformable down in a direction away from the terminal accommodating chamber 11. An accommodating recess 13 is recessed in a rear end of the housing 10 and rear ends of the terminal accommodating chambers 11 are open in the accommodating recess 13.

The one-piece rubber plug 20 is a thick plate with a plate thickness direction aligned with forward and backward directions, and is mounted into the accommodating recess 13 from behind. Circular seal holes 21 penetrate the one-piece rubber plug 20 in forward and backward directions and are arrayed to correspond to the terminal accommodating chambers 11. Lips of a known form are formed in each seal hole 21, and front and rear openings of the seal hole 21 are tapered.

Figure 3:
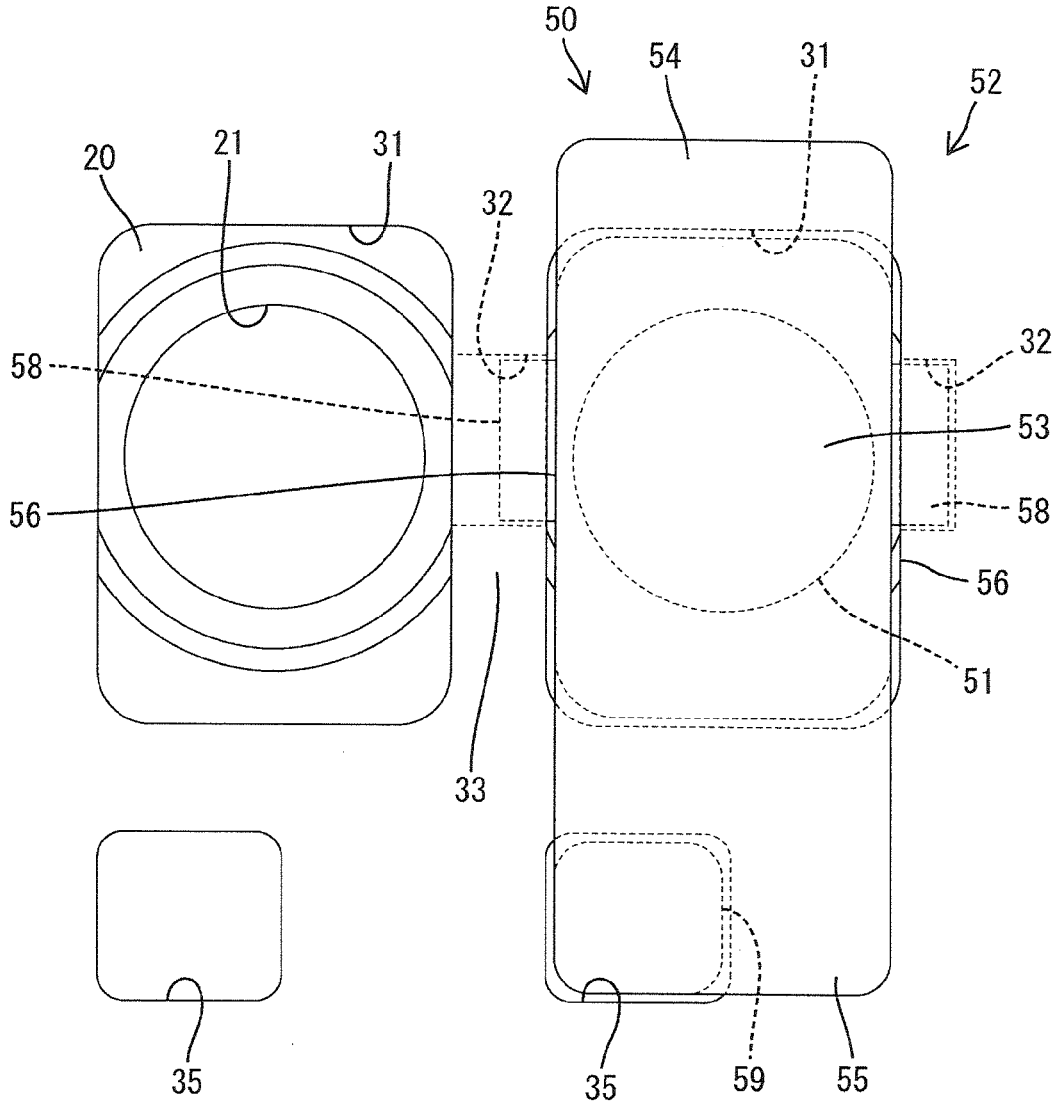
FIG. 3 is a rear view showing a dummy plug mounted in the connector.
Figure 4:
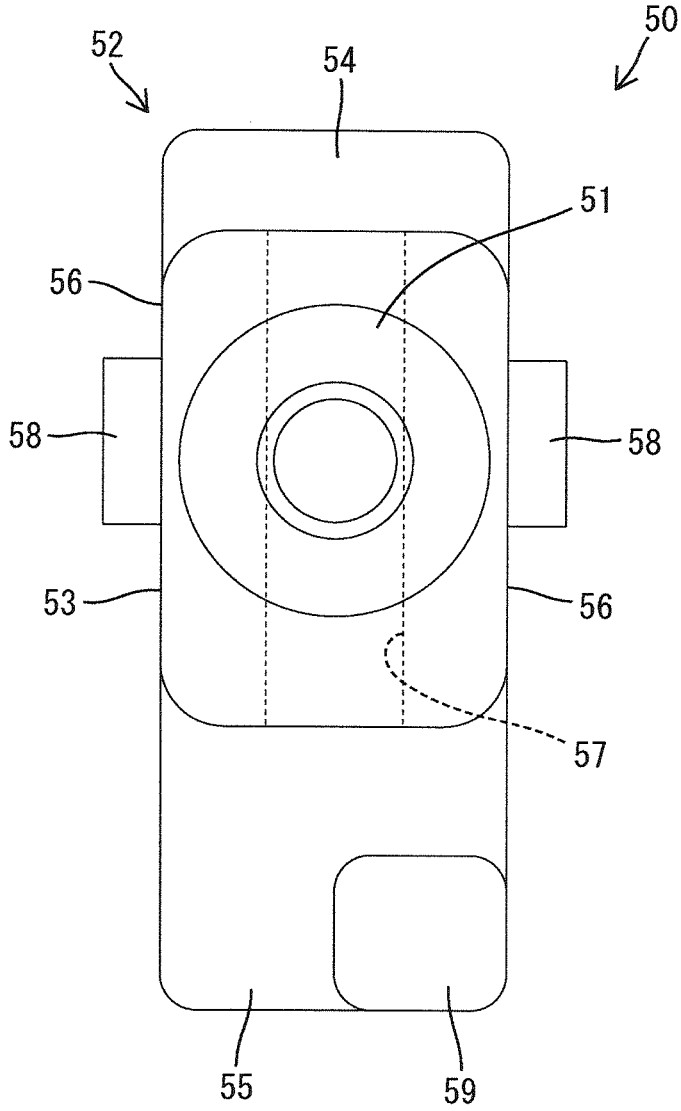
FIG. 4 is a front view of the dummy plug.
Figure 5:
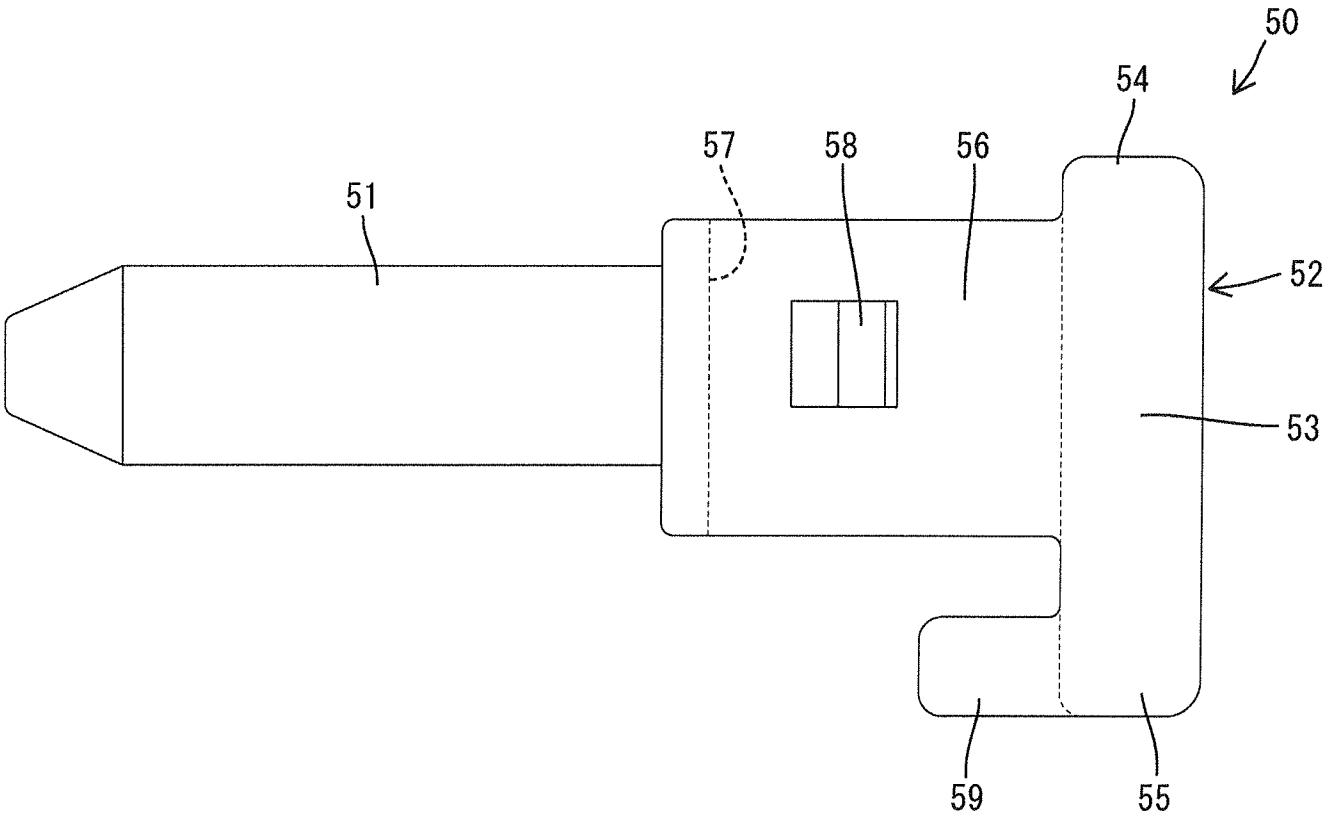
FIG. 5 is a side view of the dummy plug.
Figure 6:
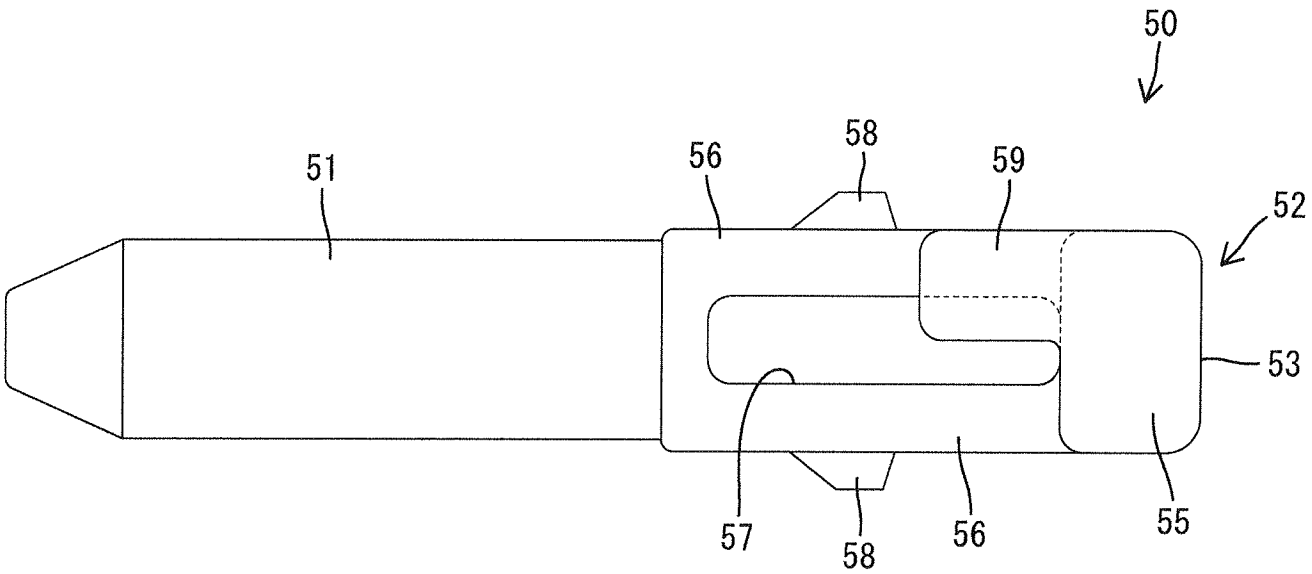
FIG. 6 is a bottom view of the dummy plug.

The holder 30 is thick synthetic resin plate with a plate thickness direction aligned with forward and backward directions. The holder 30 is mounted into the rear end of the housing 10 and contacts the rear surface of the one-piece rubber plug 20 in the accommodating recess 13 to hold the one-piece rubber plug 20 in the housing 10. Through holes 31 penetrate the holder 30 in forward and backward directions and are arrayed to correspond to the seal holes 21. As shown in FIG. 3, a cross-section of each through hole 31 taken along a plane perpendicular to forward and backward directions defines a vertically long rectangle that corresponds to a rectangular tube 41 of the terminal fitting 40. The centers of the through holes 31 coincide with the axis lines of the seal holes 21 in a width direction, as shown in FIG. 2. However, the centers of the through holes 31 are below the axis lines of the seal holes 21 in a vertical direction, as shown in FIG. 1.

Two bilaterally symmetrical grooves 32 are recessed in the left and right inner surfaces of each through hole 31 of the holder 30, as shown in FIGS. 2 and 3. The grooves 32 extend in forward and backward directions and are open in the front surface of the holder 30. The grooves 32 communicate with each other in a partition wall 33 partitioning laterally adjacent through holes 31. Forwardly facing retaining surfaces 34 are formed at rear end portions of each groove 32 in an inner wall portion of the through hole 31. The grooves 32 and the retaining portions 34 are located vertically above the center of the through hole 31.

Fitting portions 35 penetrate through the holder 30 in forward and backward directions, as shown in FIGS. 1 and 3. A cross-sectional shape of each fitting portion 35 taken along a plane perpendicular to forward and backward directions is substantially defines a rectangle. The fitting portions 35 are provided in a one-to-one correspondence with the respective through holes 31 and, as shown in FIG. 3, are arranged below the corresponding through holes 31 when viewed from behind. Each fitting portion 35 is narrower than the corresponding through hole 31, is arranged in the entire width range of the corresponding through hole 31 in the width direction and is located on the left end in the width area of the through hole 31.

As shown in FIGS. 1 and 2, the terminal fittings 40 are inserted from behind into necessary terminal accommodating chambers 11. The rectangular tube 41 is formed at a front end portion of the terminal fitting 40 and functions as a connecting means for a mating terminal (not shown). A wire crimping portion 42 is formed at a rear end portion of the terminal fitting 40 and is connected to a front part of a wire. A lock 43 is formed on the lower rear of the rectangular tube 41 and has a step shape due to a height difference between the rectangular tube 41 and the wire crimping portion 42.

The terminal fitting 40 is mounted into the terminal accommodating chamber 11 from behind the connector A. As a result, the rectangular tube 41 and the wire crimping portion 42 are passed successively through the through hole 31 of the holder 30 and the seal hole 21 of the one-piece rubber plug 20. The rectangular tube 41 resiliently deforms the locking lance 12 down in the insertion process. However, the locking lance 12 resiliently returns when the terminal fitting 40 reaches a proper insertion position to engage the lock 43 from behind. Thus, the locking lance 12 retains the terminal fitting 40 in a retained state. The wire 44 penetrates through the seal hole 21 in a liquid-tight manner and through the through hole 31 and is drawn out backward from the holder 30.

The dummy plug 50 is made of synthetic resin and, as shown in FIGS. 3 to 6, includes a sealing portion 51, an operating portion 52, a support 53, two bilaterally symmetrical resilient locking pieces 56, a deformation space 57 and an erroneous insertion preventing portion 59.

The sealing portion 51 is formed in a front end area of the dummy plug 50 and has a cylindrical shape with an axis line aligned with forward and backward directions. An outer diameter of the sealing portion 51 exceeds a minimum inner diameter of the seal hole 21 that is not deformed. The operating portion 52 is at a rear end of the dummy plug 50, i.e. behind the sealing portion 51, and has a vertically long substantially rectangular parallelepipedic shape. The operating portion 52 is slightly wider than the outer diameter of the sealing portion 51 and slightly narrower than the width of the through hole 31. A vertical dimension of the operating portion 52 exceeds the outer diameter of the sealing portion 51 and is slightly smaller than a vertical dimension of the through hole 31. The center of the operating portion 52 in the vertical direction is below the axis line of the sealing portion 51.

An area of the operating portion 52 corresponding to the sealing portion 51 in the vertical direction defines the support 53. An area of the operating portion 52 above the support 53 defines an upper front stop 54, and an area of the operating portion 52 below the support 53 defines a lower front stop 55. A vertical dimension of the lower front stop 55 exceeds that of the upper front stop 54. A vertical dimension of the support 53 exceeds the outer diameter of the sealing portion 51. The center of the support 53 is slightly lower than the axis line of the sealing portion 51.

The front end of the supporting portion 53 and the rear end of the sealing portion 51 are linked by the pair of bilaterally symmetrical resilient locking pieces 56. In other words, the pair of resilient locking pieces 56 are supported on both front and rear ends by the sealing portion 51 and the supporting portion 53. The resilient locking pieces 56 are in the form of plates whose plate thickness direction is aligned with the lateral direction. A vertical dimension of the resilient locking pieces 56 is equal to that of the supporting portion 53 and slightly smaller than that of the through hole 31. In the vertical direction, the resilient locking pieces 56 and the supporting portion 53 are arranged in the same height area. In the vertical direction, the centers of the resilient locking pieces 56 are located slightly below the axis line of the sealing portion 51.

The plate thickness of one resilient locking piece 56 is smaller than half the entire width of the support 53 (operating portion 52). The outer side surface of the resilient locking piece 56 is continuous and flush with that of the support 53. In this way, a single deformation space 57 is formed between the pair of resilient locking pieces 56 and is shared to enable inward resilient deformations of the resilient locking pieces 56 toward one another. This deformation space 57 directly faces the inner surfaces of the left and right resilient locking pieces 56 and vertically penetrates the dummy plug 50 in the long-side direction of the through hole 31 to open up and down.

Two bilaterally symmetrical trapezoidal locking projections 58 are formed on the outer side surfaces of the resilient locking pieces 56. The vertical centers of the locking projections 58 are higher than the centers of the resilient locking pieces 56 and slightly higher than the axial line of the sealing portion 51. The lower front stop 55 is formed with the erroneous insertion preventing portion 59. The erroneous insertion preventing portion 59 is located on the left end of the lower front stop 55 in the width direction and below the resilient locking pieces 56 in the vertical direction.

The dummy plug 50 is inserted into the connector A by gripping the operating portion 52 in an orientation so that the erroneous insertion preventing portion 59 is below the resilient locking pieces 56. The locking projections 58 interfere with the left and right inner wall surfaces of the through hole 31 during insertion of inserting the dummy plug 50. As a result, the resilient locking pieces 56 deform resiliently and curve in toward one another and into the one common deformation space 57.

The upper and lower front stops 54, 55 contact the rear surface of the holder 30 when the dummy plug 50 is inserted to the proper position, as shown in FIG. 1. Thus the dummy plug 50 is stopped at its front end position. The resilient locking pieces 56 resiliently return in directions away from each other and the left and right locking projections 58 engage the retaining surfaces 34 from the front, as shown in FIG. 2, to retain the dummy plug 50 and to prevent the dummy plug 50 from being withdrawn from the connector A.

The operating portion 52 can be gripped and pulled back with a strong force to remove the properly mounted dummy plug 50 from the connector A. This strong pulling forces causes the resilient locking pieces 56 to deform inward so that the locking projections 58 disengage from the retaining surfaces 34. Thus, the dummy plug 50 can be removed from the connector A.

The sealing portion 51 is inserted in the seal hole 21 when the dummy plug 50 is mounted properly in the connector A and the one-piece rubber plug 20 is deformed resiliently to make the seal hole 21 larger. The resilient restoring force of the one-piece rubber plug 20 seals a clearance between the inner periphery of the seal hole 21 and the outer periphery of the sealing portion 51 in a liquid-tight manner. The resilient locking pieces 56 are fit in the through hole 31 to prevent the dummy plug 50 from moving in vertical and lateral directions relative to the housing A. Further, the dummy plug 50 cannot incline about the axis line of the sealing portion 51.

The erroneous insertion preventing portion 59 fits in the fitting portion 35 and the dummy plug 50 can be mounted deeply to a proper insertion position, if the dummy plug 50 is mounted in a correct posture into the connector A. Conversely, the erroneous insertion preventing portion 59 contacts the rear surface of the holder 30 with the resilient locking pieces 56 deformed if a user attempts to mount the dummy plug 50 into the connector A in a vertically inverted posture. Thus, the deformed locking projections 58 interfere with the inner surfaces of the through hole 31 and the mounting operation of the dummy plug 50 cannot proceed further. The locking projections 58 do not engage the retaining surfaces 34 in this improperly mounted state. Thus, the dummy plug 50 can be removed from the connector A with a weak pulling force on the operating portion 52.

The sealing portion 51 and the supporting portion 53 support front and rear ends of the resilient locking pieces 56. Thus, the deformation rigidity is high and the resilient locking pieces 56 and the retaining surfaces 34 are engaged with strong forces as compared with cantilevered resilient locking pieces. In addition, the resilient locking pieces 56 share the deformation space 57. Thus, only the deformation space 57 is present between the resilient locking pieces 56 so that a sufficiently large deformation margin is ensured for the resilient locking pieces 56. The increased engaging forces between the resilient locking pieces 56 and the retaining surfaces 34 and the assurance of a sufficient engagement margin for the resilient locking pieces 56 and the retaining surfaces 34 improve the reliability of a retaining function.

The operating portion 52 of the dummy plug 50 projects back from the holder 30 when the dummy plug 50 is mounted into the connector A and is used to mount and remove the dummy plug 50 into and from the connector A. Additionally, the operating portion 52 is a part of the support 53 that supports the rear ends of the resilient locking pieces 56. Thus, the shape of the dummy plug 50 is simplified.

The axis lines of the seal hole 21 and the through hole 31 deviate from each other in the vertical direction. Therefore, the axis of the sealing portion 51 is deviated from the axis of the seal hole 21 if the dummy plug 50 is fit into the through hole 31 in an improper posture. In this situation, the seal hole 21 is deformed improperly and sealing performance may be reduced. However, the erroneous insertion preventing portion 59 of the dummy plug 50 of the subject invention fits into the fitting portion 35 of the holder 30 only when the dummy plug 50 is in a correct rotational orientation about the axis of the sealing portion 51. Thus, a reduction in the sealing performance resulting from the dummy plug 50 mounted in an improper posture can be prevented.

The present invention is not limited to the above described and illustrated embodiment. For example, the following embodiments are also included in the technical scope of the present invention.

A part of the operating portion serves as the support in the above embodiment. However, the entire operating portion may function as the support.

Although the support is formed on the operating portion in the above embodiment, it may be formed on a part other than the operating portion, i.e. at a position before the operating portion.

The erroneous insertion preventing portion is formed on the operating portion in the above embodiment. However, an erroneous insertion preventing portion may not be provided.

Although the deformation space penetrates in the long-side direction of the through hole in the above embodiment, it may penetrate in the short-side direction of the through hole.

The front stops are formed on the operating portion in the above embodiment, but they may be formed on a part other than the operating portion.

Although the opening shape of the through hole is rectangular in the above embodiment, it may be square.

The axis lines of the seal hole and the through hole deviate from each other in the height direction in the above embodiment. However, the seal hole and the through hole may be positioned coaxially.

What is claimed is:

1. A dummy plug to be mounted in a connector that includes a housing formed with terminal accommodating chambers, a one-piece rubber plug including seal holes corresponding to the terminal accommodating chambers and to be mounted in a rear end portion of the housing, and a holder arranged behind the one-piece rubber plug and including through holes corresponding to the seal holes, the dummy plug comprising:

a sealing portion to be fit into the seal hole in a liquid-tight manner when the dummy plug is mounted into the connector;

two laterally spaced resilient locking pieces extending rearward from a rear end of the sealing portion and being engageable with retaining surfaces of the holder to retain the dummy plug in the connector; and a support connecting the resilient locking pieces to one another at a position rearward of the sealing portion so that single deformation space is provided between the support and the sealing portion and between the resilient locking pieces to permit resilient deformations of the resilient locking pieces toward one another and into the single deformation space.

2. The dummy plug of claim 1, wherein at least part of the support defines an operating portion projecting back from the holder when the dummy plug is mounted into the connector and is used to mount and remove the dummy plug into and from the connector.

3. The dummy plug of claim 1, further comprising an erroneous insertion preventing portion engageable with a fitting portion of the holder only when the dummy plug is in a correct posture in a circumferential direction about an axis line of the sealing portion.

4. A dummy plug unitarily formed from a synthetic resin and having opposite front and rear ends, the dummy plug comprising:

a substantially cylindrical sealing portion adjacent the front end;

a support spaced rearward from the sealing portion and being cross-sectionally larger than the sealing portion; and two resilient locking pieces extending between the sealing portion and the support, the resilient locking pieces being spaced apart so that and a single deformation space is defined between the resilient locking pieces and between the support and the sealing portion to permit resilient deformations of the resilient locking pieces toward one another and into the single deformation space, locks projecting out on outward facing surfaces of the resilient locking pieces.

5. The dummy plug of claim 4, further comprising an erroneous insertion preventing portion projecting forward on the support at a position offset laterally from the resilient locking pieces.

6. A connector comprising:

a housing having opposite front and rear ends and terminal accommodating chambers extending between the ends;

a one-piece rubber plug mounted in a rear end portion of the housing and including seal holes corresponding to the terminal accommodating chambers;

a holder arranged behind the one-piece rubber plug and including through holes corresponding to the seal holes, retaining surfaces formed on the holder in proximity to the through holes; and a dummy plug having opposite front and rear ends, a sealing portion adjacent the front end and fit into one of the seal holes in a liquid-tight manner, a support spaced rearward from the sealing portion and rearward of the holder and two resilient locking pieces extending between the sealing portion and the support and being in one of the through holes of the holder, a single deformation space extending forward from the support to the sealing portion and at all locations between the resilient locking pieces to permit resilient deformations of the resilient locking pieces toward one another and into the single deformation space, locks formed on outward facing surfaces of the resilient locking pieces and being engageable with the retaining surfaces of the holder to retain the dummy plug in the connector.

7. The connector of claim 6, further comprising an operating portion formed on the support and projecting back from the holder, wherein the operating portion is used to mount and remove the dummy plug into and from the connector.

8. The connector of claim 6, further comprising an erroneous insertion preventing portion engageable with a fitting portion of the holder only when the dummy plug is in a correct posture in a circumferential direction about an axis line of the sealing portion.

* * * * *